United States Patent [19]

Nakamura et al.

[11] 4,260,965

[45] Apr. 7, 1981

[54] FIXED MICROWAVE ATTENUATOR HAVING MOUNTING HOLE PASSING THROUGH ALUMINA PORCELAIN SUBSTRATE

[75] Inventors: Kiichi Nakamura, Yachiyo; Takashi Iwata, Shonan, both of Japan

[73] Assignee: TDK Electronics Co., Inc., Tokyo, Japan

[21] Appl. No.: 54,798

[22] Filed: Jul. 5, 1979

[30] Foreign Application Priority Data

Jul. 20, 1978 [JP] Japan ..... 53/99877

[51] Int. Cl.[3] ..... H01P 1/22; H01P 1/30

[52] U.S. Cl. ..... 333/81 A; 338/315; 338/333

[58] Field of Search ..... 333/22 R, 81 R, 81 A; 338/197, 221, 306–309, 315, 320, 333, 334; 219/536, 537

[56] References Cited

U.S. PATENT DOCUMENTS

| | | | |
|---|---|---|---|
| 3,296,559 | 1/1967 | Maines | 333/22 R |
| 3,964,087 | 5/1975 | Mallon | 338/320 X |

*Primary Examiner*—Paul L. Gensler

*Attorney, Agent, or Firm*—Lewis H. Eslinger

[57] ABSTRACT

A fixed attenuator for microwave band comprising of a dielectric substrate, with a resistance film and a conductor film attached on said substrate so as to form an attenuation circuit. The substrate further comprises of at least one hole provided through the dielectric substrate. The attenuator is mounted on a metallic board or a printed circuit board by a screw inserted in said hole. Thus, the cooling effect of the resistance film has been improved while keeping the low manufacturing cost and stable structure, by fixing the dielectric substrate on a metallic board by screws inserted in the mentioned holes.

3 Claims, 9 Drawing Figures

FIXED MICROWAVE ATTENUATOR HAVING MOUNTING HOLE PASSING THROUGH ALUMINA PORCELAIN SUBSTRATE

BACKGROUND OF THE INVENTION

The present invention relates to an improvement of the structure of a fixed attenuator for the microwave band.

FIG. 1 shows a perspective view of a prior fixed attenuator for the microwave band. The attenuator comprises of a metallic mounting plate member 1 with a hole 1A, a dielectric substrate 2 mounted through an adhesive process on the metallic mounting member 1; resistance films 3 and conductors 4 applied to the surface of the dielectric substrate 2 so as to form a desired attenuating circuit of T-type or $\pi$-type; and terminals 5 connected to the attenuating circuit by conductor pieces. The dielectric substrate 2 is made of for instance, alumina porcelain ($Al_2O_3$). There have been known other fixed attenuators which do not have the metallic mounting plate.

Generally speaking when an attenuator operates, heat is generated in the resistors or the resistance films in the attenuator in proportion to the degree of the attenuation. Unless the heat thus generated is efficiently dissipated to the outside, it is difficult to produce a small size attenuator having a large power capacity. Looking at the mentioned conventional attenuators from this viewpoint, the attenuator in FIG. 1 having the mounting metallic member with a hole may meet the above requirement, except the adhesives between the metallic mounting member 1 and the dielectric substrate 2 provides the substantial heat resistance. But this conventional attenuator has drawbacks in the material cost of the mounting metallic member and in the cost of the work for joining the metallic member to the dielectric substrate. In particular, the surface of both the dielectric substrate and the metallic member must be strictly flat. On the other hand, another conventional fixed attenuator without the mounting metallic member can be manufactured at a low cost but has drawbacks in that, due to the fact that the connection and contact to the outside are made only by the connection of the conductor pieces forming the terminals, stable mounting to outside members and efficient heat dissipation can not be achieved.

SUMMARY OF THE INVENTION

Therefore, the objective of the present invention is to provide a fixed attenuator which can be manufactured at a very low cost and can be mounted stably to outside members, and yet, has a large power capacity.

The above and other objectives are attained by a fixed attenuator having a dielectric substrate, resistance films and conductor films attached on one side of said substrate so as to form an attenuating circuit, and at least one hole provided through said substrate for fixing the attenuator on a metallic board.

Preferably, the dielectric substrate is made of alumina porcelain.

The presence of a hole on a dielectric substrate is the important feature of the present invention. As shown, the present attenuator is fixed on a metallic board by a screw through the hole on the dielectric substrate. Thus, no adhesives are utilized for mounting the present attenuator. The effect of the heat dissipation of the present attenuator is excellent, while keeping the simple structure and low manufacturing cost.

BRIEF DESCRIPTION OF THE DRAWINGS

The foregoing and other objectives, features, and attendant advantages of the present invention will be appreciated as the invention becomes better understood by means of the following description and accompanying drawings wherein.

DESCRIPTION OF THE PREFERRED EMBODIMENTS

Figure 1:
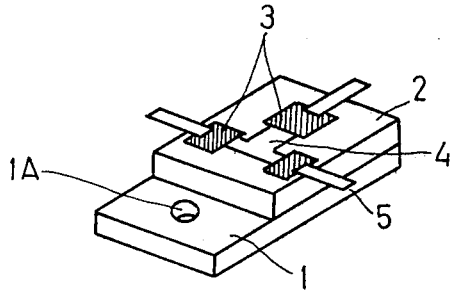
FIG. 1 is a perspective view of an example of a conventional fixed attenuator.
Figure 2A:
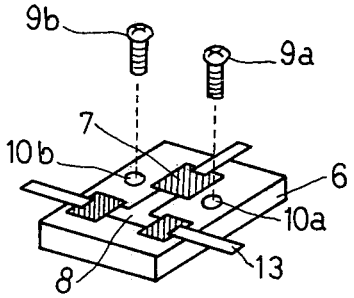
FIG. 2(A) is the perspective view of the embodiment of the fixed attenuator according to the present invention.

FIG. 2(A) is the perspective view of the fixed attenuator according to the present invention. The present fixed attenuator in FIG. 2(A) has the dielectric substrate 6, resistance films 7 and conductors 8 attached on the dielectric substrate 6 in the same manner as that of conventional attenuators, so as to form the desired attenuating circuit of T-type attenuator. Two through holes 10*a* and 10*b* are bored through the dielectric substrate 6 at the portion where no attenuating circuit is provided. The present attenuator is mounted on a printed circuit board by screws 9*a* and 9*b* inserted into holes 10*a* and 10*b*. 13 is the terminal for the connection with an external circuit.

Figure 2B:
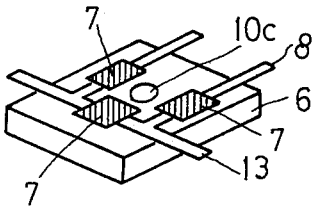
FIG. 2(B) is the perspective view of another embodiment of the fixed attenuator according to the present invention.

FIG. 2(B) is another embodiment of the fixed attenuator according to the present invention, which is the same as that in FIG. 2(A) except that the attenuating circuit is $\pi$-type attenuator, and only a single hole 10*c* is provided between legs of the resistance and conductor members 7 and 8.

With the attenuators according to the present invention, the through holes 10*a*–10*c* are bored directly through the blank portion of the dielectric substrate 6 as the part of means for mounting the attenuator to a printed circuit board including heat-dissipating member. Therefore, a higher mechanical mounting strength can be achieved as compared with the case of connection by conductor pieces alone. Along with this, the production cost can be much reduced due to elimination of the requirement for any special metallic members. In addition to this, size reduction is possible due to the absence of space increase for mounting.

Figure 2C:
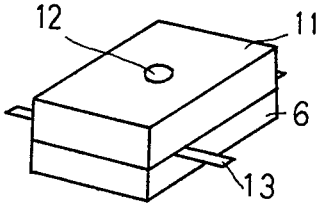
FIG. 2(C) is the perspective view of still another embodiment of the fixed attenuator according to the present invention.

With the embodiment illustrated in FIG. 2(C), a cover 11 made of synthetic resin or ceramic is applied to the attenuator, e.g., the attenuator of FIG. 2(B). A cover hole 12 is bored through the cover 11 in such a position that the cover hole communicates with the through hole 10*c* of the dielectric substrate 6. In case of the embodiment illustrated in FIG. 2(C), the cover 11 provides protection of the attenuating circuit, such as the resistance film 7, and supplement of the mechanical strength of the dielectric substrate 6.

According to the practical embodiment of the present invention, the size of the substrate 6 in FIG. 2(A) and/or FIG. 2(B) is 11×11 mm, and the thickness of said substrate 6 is 1.3 mm. The conductor pattern 13 is made of thin gold of 2 mm of width, and the resistance pattern 7 is made of ruthenium oxide. The diameter of holes 10*a* through 10*c* is approximate 2.4 mm. The width, and the thickness of the resistance pattern 7 are defined by the desired characteristics of the attenuator.

It should be appreciated from the above explanation that the presence of holes 10*a* through 10*c* is the important feature of the present invention, with the presence of the hole becoming possible by the particular method and structure of an attenuator according to the present invention. Also, it should be noted that a hole by drilling on an alumina porcelain substrate is almost impossible in a prior technology, since the substrate is very hard.

According to the present invention, a substrate with holes is manufactured as follows. First, alumina powder ($Al_2O_3$), binder (for instance, polyvinyl alcohol), dispersing agent, and water are prepared and are mixed up in a ball mill to provide paste-like material. Next, that material is inserted between a pair of rolls to provide an alumina sheet through the press process, or alternatively said material is extruded through a flat nozzle to provide an alumina sheet. The alumina sheet is shaped to a desired shape having the necessary holes through the stamping process. Finally, the stamped substrate is sintered in a furnace at the temperature approximate 1,600° C., and a hard alumina porcelain with the desired shape and holes is obtained. On the substrate thus obtained, a conductor pattern and a resistance pattern are plated through a conventional thin film or thick film process.

Figures 3A, 3B, 3C:
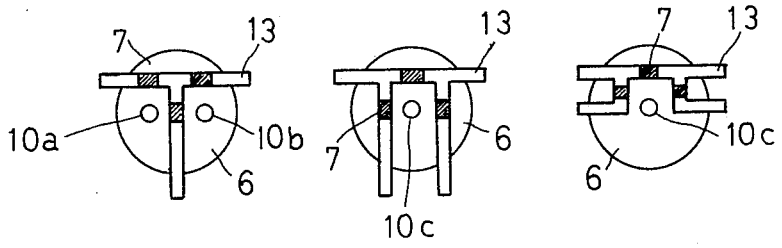
FIGS. 3(A), 3(B) and 3(C) are plan views of other embodiments of the present fixed attenuators.

FIGS. 3(A) and 3(B) are modifications of the embodiments shown in FIGS. 2(A) and 2(B), respectively, and those modifications have a circular disk type substrate, instead of a rectangular substrate. Also, FIG. 3(C) is the further modification of the structure in FIG. 3(B), and in that modification, the connection terminals are provided in a different direction as shown in FIG. 3(C).

Figure 4:
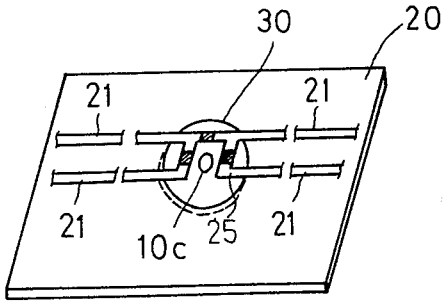
FIG. 4 shows the present fixed attenuator mounted on a printed circuit board.
Figure 5:
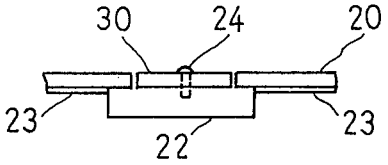
FIG. 5 is the cross sectional view at line A—A of FIG. 4.

FIG. 4 and FIG. 5 show the present fixed attenuator 30 (the embodiment shown in FIG. 3(C)) mounted on a printed circuit board 20. The printed circuit board is plated with conductive circuit pattern 21 according to the desired circuit diagram, and preferably the circuit pattern is composed of strip line which comprises a dielectric substrate, a ground pattern 23 plated on the whole area on one side of said substrate, and a circuit pattern plated on the other side of the substrate according to the desired circuit diagram. The printed circuit board 20 in FIG. 4 and FIG. 5 has a large circular hole large enough to accept the attenuator 30, and the smooth conductive plate 22 covering one side of said large hole. The attenuator 30 is inserted in the hole, and is fixed on the conductive plate with a screw 24 inserted through the hole 10*c*. A circuit pattern 21 on the printed circuit board 20 is connected to the conductive pattern 25 of the attenuator 30 through bonding, soldering, et al.

As described above, the present attenuator can be fixed on a printed circuit board very easily and stably with only screws and utilizing no adhesives, while keeping the power capacity very high, due to the presence of holes on the dielectric substrate.

It should be appreciated that no adhesives are utilized in the present invention for mounting the present fixed attenuator. The adhesives between the dielectric substrate and metallic plate would increase the heat resistance which decreases the power capacity of the attenuator.

From the foregoing it should now be apparent that a new and improved fixed attenuator has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A fixed attenuator for use with a microwave band comprising:

a dielectric substrate of an alumina porcelain material;

at least one resistive film disposed on a surface of the substrate;

at least one conductive film disposed on the surface of said substrate so as to form an attenuating circuit of one of a T-shape and $\pi$-shape with said at least one resistive film; and at least one hole passing through said substrate at a position displaced from said attenuating circuit for securing said attenuator on a metallic layer.

2. The fixed attenuator according the claim 1; in which said attenuating circuit is of a $\pi$-shape with two substantially parallel legs and said fixed attenuator includes one hole passing through said substrate at a position between said two legs.

3. The fixed attenuator according to claim 1; in which said attenuating circuit is of a T-shape with one leg and said fixed attenuator includes two holes passing through said substrate at positions on opposite sides of said one leg.

* * * * *